US006106320A

United States Patent [19]

Gunn

[11] Patent Number: 6,106,320

[45] Date of Patent: Aug. 22, 2000

[54] DETENT LOCK MECHANISM FOR PIN-AND-SLEEVE HEAVY DUTY ELECTRICAL CONNECTOR

[75] Inventor: Donald James Gunn, Baldwinsville, N.Y.

[73] Assignee: Cooper Industries, Inc., Houston, Tex.

[21] Appl. No.: 09/282,181

[22] Filed: Mar. 31, 1999

[51] Int. Cl.[7] ..... H01R 13/627

[52] U.S. Cl. ..... 439/349

[58] Field of Search ..... 439/349, 348, 439/345, 911, 258

[56] References Cited

U.S. PATENT DOCUMENTS

| | | | |
|---|---|---|---|
| 3,569,908 | 3/1971 | Appleton | 339/91 |
| 3,960,428 | 6/1976 | Naus et al. | 339/90 |
| 4,268,729 | 5/1981 | Gaizauskas | 200/50 B |
| 4,503,293 | 3/1985 | Knecht | 200/50 B |
| 4,604,505 | 8/1986 | Henninger | 200/50 B |
| 5,298,701 | 3/1994 | Sandor | 200/50 R |
| 5,590,228 | 12/1996 | Gibola et al. | 385/56 |
| 5,635,690 | 6/1997 | Knecht et al. | 200/51.09 |
| 5,670,763 | 9/1997 | Spencer | 200/43.16 |

*Primary Examiner*—Steven L. Stephan
*Assistant Examiner*—Amir Abdulmelik
*Attorney, Agent, or Firm*—Fish & Richardson, P.C.

[57] ABSTRACT

An electrical receptacle includes a receptacle housing, a movable element, an interlock mechanism, a release mechanism, and a blocking element. The receptacle housing has a receptacle opening having a longitudinal axis. The movable element is located within the receptacle opening and is designed to move along the longitudinal axis between an extended position and an inserted position. The interlock mechanism is connected to interlock with the movable element when the movable element is in the inserted position. The interlock mechanism also maintains the movable element in the inserted position. The release mechanism is coupled to the interlock mechanism, accessible from outside the receptacle housing, and operable to disengage the interlock mechanism from the movable element to permit the movable element to move to the extended position. The blocking element is located within the receptacle opening and is designed to move along the longitudinal axis with the movable element, to fixedly block a portion of the receptacle opening when the movable element is in the inserted position, and not to fixedly block the receptacle opening when the movable element is in the extended position.

67 Claims, 16 Drawing Sheets

DETENT LOCK MECHANISM FOR PIN-AND-SLEEVE HEAVY DUTY ELECTRICAL CONNECTOR

TECHNICAL FIELD

The invention relates to a detent lock mechanism for a pin-and-sleeve heavy duty electrical connector.

BACKGROUND

A mechanical-interlock electrical receptacle conducts electricity to an engaged plug, does not conduct electricity when no plug is engaged, and prevents the plug from being disengaged while the receptacle is conducting electricity. The safety features provided by a mechanical-interlock electrical receptacle are critical in industrial or other applications where the current used to power equipment may be 30 to 200 amperes or higher. In these high current applications, a dangerous arc could form between the plug and receptacle if the plug were engaged to, or disengaged from, a powered receptacle.

To prevent arcing, the mechanical-interlock electrical receptacle prevents power from reaching conductors of the receptacle if the plug is not engaged, and prevents a powered plug from being disengaged. To this end, the receptacle may include an interlock mechanism that interacts with an engaged plug. For example, to prevent disengagement of the plug while under electrical load, a receptacle may include a release lever that forces a spring-loaded pin into a slot in the plug to hold the plug in place.

The release lever is connected to a switch that selectively provides power to the receptacle conductors. When no plug is inserted in the receptacle, the release lever is secured in a power-off position. Insertion of a plug into the receptacle permits the release lever to move to a power-on position. This movement of the release lever causes a corresponding movement of the spring-loaded pin, such that the spring-loaded pin is forced into a slot in the plug to secure the plug in the receptacle. To disengage the plug, the release lever is moved to the power-off position, where it locks in place. Movement of the release lever to the power-off position permits the spring-loaded pin to retract from the slot and thereby permits removal of the plug.

SUMMARY

In one general aspect, an electrical receptacle includes a receptacle housing, a movable element, an interlock mechanism, a release mechanism, and a blocking element. The receptacle housing defines a receptacle opening having a longitudinal axis. The movable element is positioned within the receptacle opening and moves along the longitudinal axis between an extended position and an inserted position. The interlock mechanism is connected to interlock with the movable element when the movable element is in the inserted position to maintain the movable element in the inserted position. The release mechanism is coupled to the interlock mechanism, accessible from outside the receptacle housing, and operable to disengage the interlock mechanism from the movable element to permit the movable element to move to the extended position. The blocking element is positioned within the receptacle opening and designed to move along the longitudinal axis with the movable element, to fixedly block a portion of the receptacle opening when the movable element is in the inserted position, and not to fixedly block the portion of the receptacle opening when the movable element is in the extended position.

Embodiments may include one or more of the following features. For example, the electrical receptacle may include at least one electrical conductor and a switching circuit configured to supply electrical power to the conductor when the movable element is in the inserted position and the interlock mechanism is interlocked with the movable element and to not supply electrical power when the movable element is in the extended position.

The receptacle housing may include an exterior threaded section. This threaded section is configured to be threadably connected to a threaded cap of an electrical plug when the plug is in the receptacle housing. This arrangement permits a sealed connection between the plug and the receptacle.

The blocking element may be configured to engage a plug inserted into the receptacle opening so that the plug is not removable from the opening when the movable element is in the inserted position. The blocking element may be mounted on the movable element and may be a garter spring or flexible rod extending around the movable element. The electrical receptacle also may include a mechanism, such as a spring, for biasing the movable element to the extended position.

The movable element may be a spring carrier having a slot through which a portion of the garter spring extends. The garter spring may be prevented from retracting from the slot when the movable element is in the inserted position. The spring may extend through the slot but may be retracted when the movable element is in the extended position.

The interlock mechanism may be a plate configured to fit within a channel in the movable element when the movable element is in the inserted position. The movable element may include a first channel that communicates with the opening through an inner circumference of the movable element and the blocking element may be disposed within the first channel. The movable element also may include a second channel along at least a portion of its outer circumference. The interlock mechanism may include a plate configured to fit within the second channel when the movable element is in the inserted position.

The movable element also may be a cam hinge lock configured to move between the extended position and the inserted position. The cam hinge lock may be generally L-shaped and have a square channel passing through a long section. The cam hinge lock may include a detent tab, a trigger tab, and a hinge end. The detent tab may be at one end of a short section of the L-shaped cam hinge lock. The trigger tab may be at the other end of the short section, adjacent to the intersection of the short and long section. The other end of the cam hinge, i.e., the hinge end, may be placed within a cam opening such that the hinge end permits the cam hinge lock to move. In this manner, the cam hinge lock may move between the extended and inserted positions. For example, depressing the trigger tab moves the cam hinge lock to the inserted position and inserts the detent tab into the receptacle opening. Moving the cam hinge lock to the extended position removes the detent tab from the detent slot.

The receptacle housing also may include a release lever connected to a shaft having a square segment and a round segment. The release lever and cam hinge lock function together, for example, the square channel of the cam hinge lock surrounds the square segment in the extended position and the square channel surrounds the round segment in the inserted position.

The electrical receptacle also may include a biasing mechanism to move the cam hinge lock to the extended position. The biasing mechanism may be a spring attached on a first end to the cam hinge lock and on a second end to the receptacle housing. A second spring may be configured to rotate the shaft to cause the cam hinge lock to move to the inserted position. The second spring may be attached on a first end to the receptacle housing and on a second end to the shaft.

The electrical receptacle may be implemented as part of an electrical circuit that includes an electrical plug and the electrical receptacle.

In another general aspect, an electrical receptacle includes a receptacle housing, a movable element, an interlock mechanism, a release mechanism, and a blocking element. The receptacle housing defines a receptacle opening having a longitudinal axis. The movable element is positioned within the receptacle opening and moves along the longitudinal axis between an extended position and an inserted position. The interlock mechanism is connected to interlock with the movable element when the movable element is in the inserted position. The interlock mechanism maintains the movable element in the inserted position and includes a shaft that rotates between a first position when the movable element is in the extended position and a second position when the movable element is in the inserted position. The release mechanism is coupled to the interlock mechanism and is accessible from outside the receptacle housing. The release mechanism is operable to disengage the interlock mechanism from the movable element to permit the movable element to move to the extended position. The blocking element is positioned adjacent to the receptacle opening and moves along an axis perpendicular to the longitudinal axis. When the movable element is in the inserted position, it fixedly blocks a portion of the receptacle opening. When the movable element is in the extended position it does not fixedly block the receptacle opening. The blocking element is coupled to the shaft such that movement of the shaft from the first position to the second position affirmatively causes the blocking element to block the receptacle opening and movement of the shaft from the second position to the first position affirmatively retracts the blocking element so as not to block the receptacle opening.

Embodiments may include one or more of the following features. For example, the blocking element of the electrical receptacle may include a receptacle detent. The receptacle detent may be a plate having a channel through the plate adjacent to a first end and a detent at a second end. The channel may have lobes and an angled stop.

The movable element may include a cam hinge having a square channel passing through it and configured to move between the extended position and the inserted position. A release lever may be connected to the shaft having a lower square segment and a lower round segment. The square channel surrounds the lower square segment in the extended position and the lower round segment in the inserted position. The shaft also may include an upper square segment that passes through the channel of the receptacle detent. In use, a first corner of the upper square segment pushes the detent into the receptacle opening in the inserted position and a second corner of the upper square segment pushes the detent from the receptacle opening in the extended position.

The electrical receptacle also may include a biasing mechanism to move the cam hinge to the extended position. The biasing mechanism may include a spring that is attached on a first end to the cam hinge and on a second end to the receptacle housing. The electrical receptacle also may include a second spring that rotates the shaft, which causes the cam hinge to move to the inserted position.

The invention provides several other advantages. First, by employing a moveable element that moves longitudinally in a receptacle opening and a blocking element that moves with the movable element, the invention prevents interference with exterior threads on the housing. This permits the receptacle housing to have an exterior threaded section to which may be threadably attached a threaded cap of an electrical plug inserted into the receptacle. The threaded cap seals the receptacle from potentially explosive gases in the environment in which the receptacle housing is used. The seal formed by the threaded cap provides a sufficient barrier against potentially explosive gases such that conventional sealants do not need to be used to seal the interior of the receptacle housing, which reduces the cost of assembling the housing. Second, the invention permits use of a one-piece receptacle housing that is more economical to produce than conventional receptacle housings. The receptacle housing also may have reduced assembly costs because the unit does not need drill holes for assembly. For example, some conventional receptacle housings include a detent pin and spring that must be inserted into a channel in the receptacle housing through a hole drilled in the housing. Inserting the detent pin and spring into the channel is a tedious task. Following their insertion, a plate must be attached to the housing to seal the hole. Eliminating the drilling, insertion and sealing steps reduces assembly costs and provides a receptacle housing with less entry points for potentially explosive gases.

Other features and advantages will be apparent from the following description, including the drawings, and from the claims.

DESCRIPTION

Figure 1:
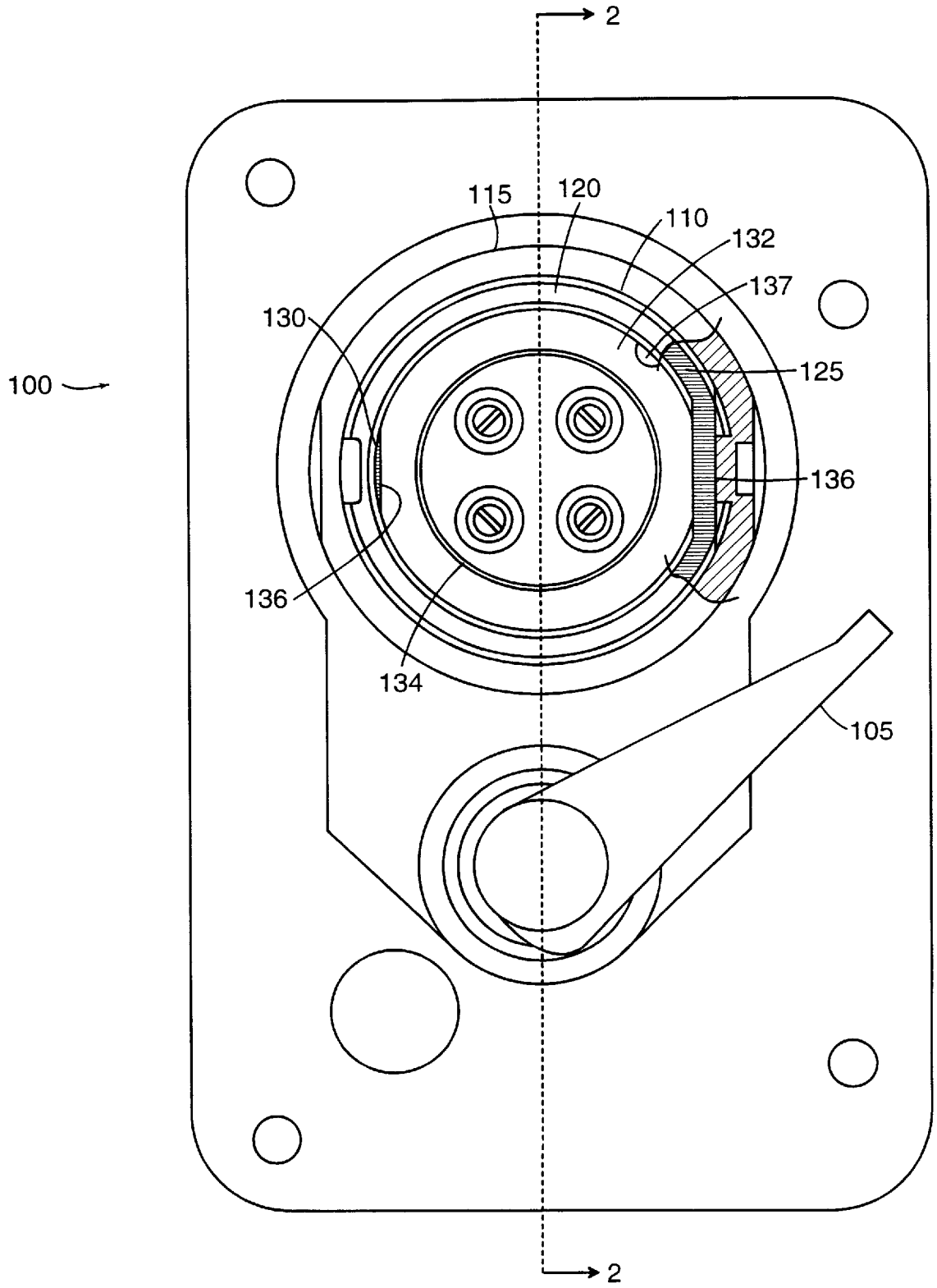
FIG. 1 is a front view of a receptacle housing.

Referring to FIG. 1, a receptacle housing 100 includes a release lever 105 and a receptacle opening 110. The opening 110 includes an exterior threaded section 115. A movable element, such as a spring carrier 120, is positioned in opening 110 and movable along an axis of the opening. Spring carrier 120 includes a channel 125 having a closed inner circumference and an open outer circumference. A pair of slots 130 on an inner circumference of the channel communicate with a sleeve region 132 that is defined between a receptacle connector 134 and spring carrier 120. A blocking element, such as a garter spring 136, is positioned under tension within channel 125 so that it protrudes from the slots 130 into the sleeve region 132 to reduce an outer diameter of the region at the slots relative to the rest of the region. A semicircular axial ridge 137 extends from the spring carrier 120 into the region 132 and serves to orient the plug properly with respect to the receptacle connector 134.

Figure 2:
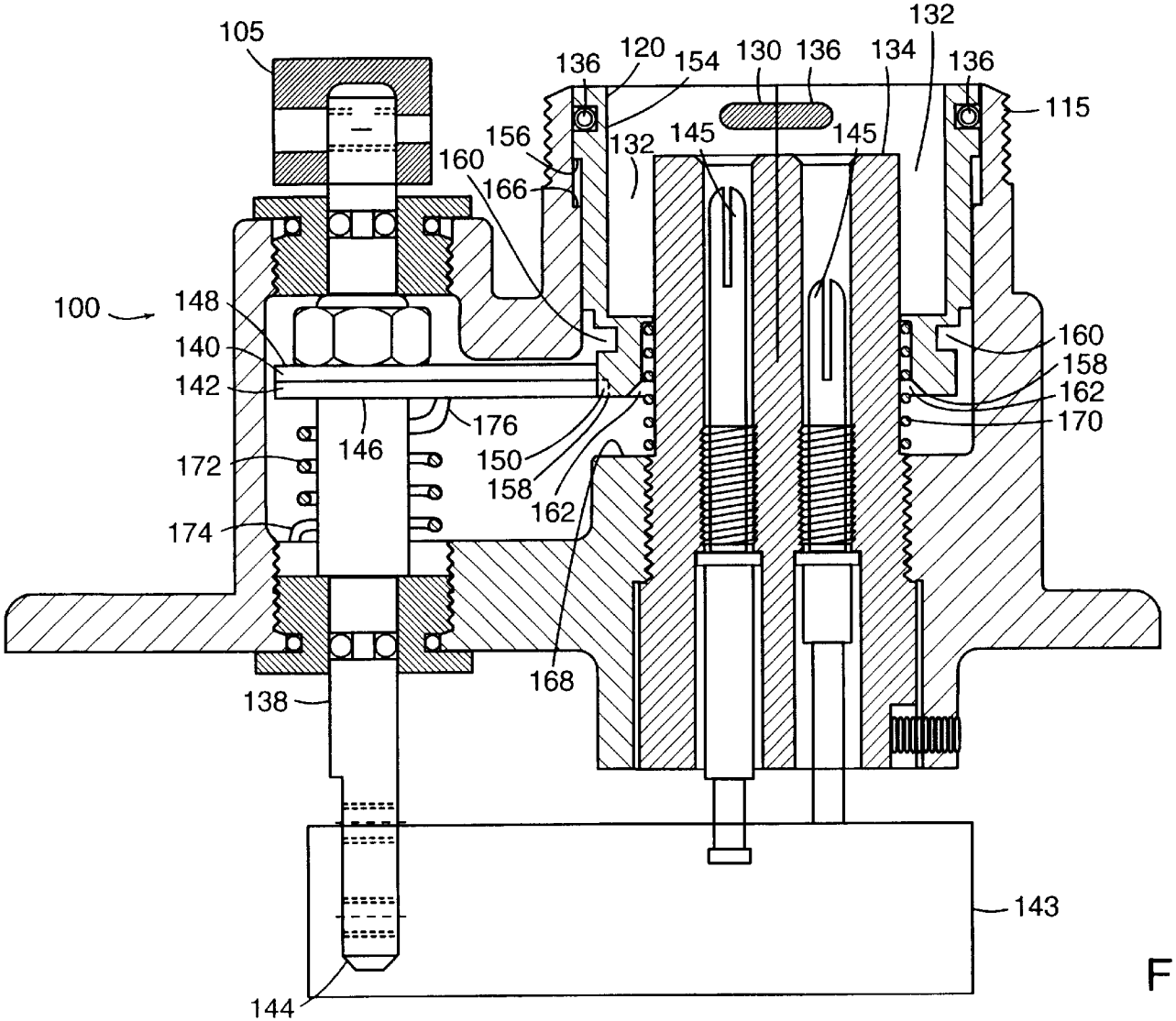
FIG. 2 is a sectional side view of the receptacle housing along section 2—2 of FIG. 1.

Referring to FIG. 2, receptacle housing 100 also includes a shaft 138 and a pair of spring carrier lock plates 140 and 142, with lockplate 140 being shorter than lockplate 142. Shaft 138 is connected at one end to release lever 105 and at an opposite end 144 to a switching mechanism 143 that selectively supplies power to receptacle conductor prongs 145 of the receptacle connector 134. As discussed below, when a plug is inserted into receptacle 100, the prongs of the plug connect with receptacle conductor prongs 145 to form an electrically conductive path between the receptacle and the plug.

Spring carrier lock plates 140 and 142 are attached to shaft 138 in a middle region 146. Although plates 140 and 142 are flush at a first end 148, plate 142 extends beyond plate 140 at a second end 150.

Spring carrier 120 surrounds receptacle connector 134 and sleeve region 132. A thicker upper region 154 of spring carrier 120 has a stop ledge 156. A lower region 158 of spring carrier 120 has a plate-receiving slot 160 and a spring retaining channel 162.

Spring carrier 120 slides between a locked position and an unlocked position. FIG. 2 illustrates spring carrier 120 in the unlocked position, which is characterized by the spacing between stop ledge 156 and a ledge 166, lower region 158 and a base edge 168, and plate 142 and slot 160. In addition, a spring 170 is in an uncompressed state.

In the unlocked position, a second spring 172 exerts a rotational force on plate 142 that forces the plate into contact with spring carrier 120. The spring 172, which surrounds the shaft 138, is attached to the receptacle housing 100 at a first end 174 and to the plate 142 at a second end 176. Due to the force exerted by spring 172, and as described below, plate 142 slides into slot 160 when the spring carrier is depressed into the receptacle housing 100.

In the locked position (FIG. 9), the spring carrier 120 is depressed into the receptacle housing 100 so that stop ledge 156 is in contact with ledge 166, lower region 158 is adjacent to base edge 168, and spring 170 is compressed within channel 162. Depressing the spring carrier 120 also moves slot 160 toward plate 142. When they are adjacent, the plate 142 is forced into the slot 160 by the rotational force of spring 172.

Figure 3:
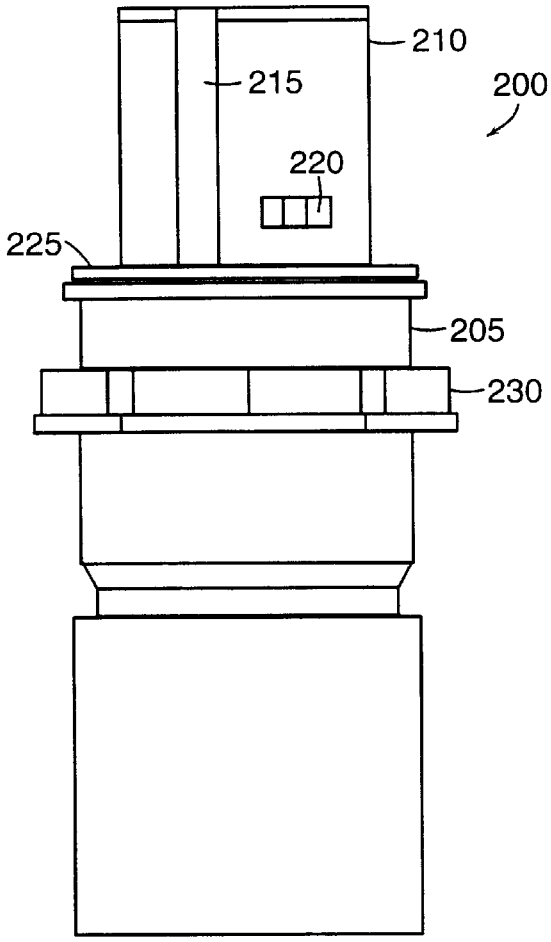
FIG. 3 is a side view of an electrical plug having a threaded cap.
Figure 4:
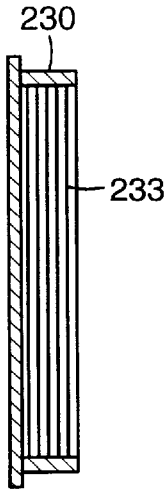
FIG. 4 is a sectional side view of the threaded cap of the plug of FIG. 3.

Referring to FIGS. 3 and 4, a heavy duty plug 200 includes a housing 205, a plug sleeve 210, an alignment channel 215, a pair of detent slots 220, a gasket 225, and a threaded cap 230. The alignment channel 215 runs the length of plug sleeve 210 and passes over ridge 137 in the receptacle housing 100 when plug 200 is inserted into the receptacle. The ridge 137 and alignment channel 215 align the plug 200 and receptacle housing 100 to ensure that receptacle conductor prongs 145 mate with appropriate plug conductor prongs 235 and that the spring 136 protrudes into detent slots 220. After insertion, gasket 225 rests against the top of threaded section 115, and threaded cap 230, which has threads 233 on an inside circumference, may be connected to threaded section 115 to form a watertight and explosion-proof connection.

Figure 5:
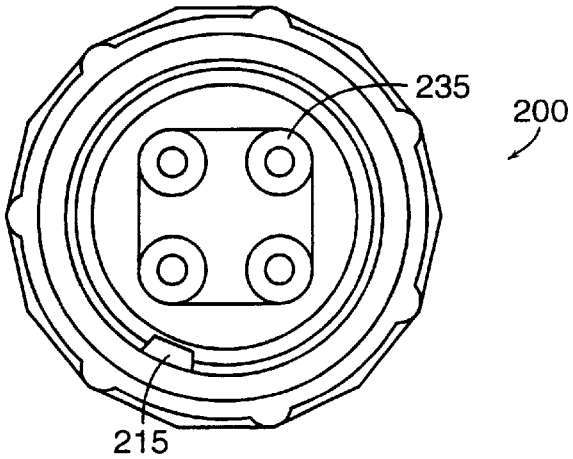
FIG. 5 is an end view of the electrical plug of FIG. 3.

Referring to FIG. 5, the heavy duty plug 200 also includes four plug conductor prongs 235 that conduct electrical current from the receptacle 100 to wires (not shown) installed in the plug. The prongs 235 are positioned relative to the alignment channel 215 and detent slots 220 to ensure mating with the receptacle conductor prongs 145 during plug insertion.

Figure 6:
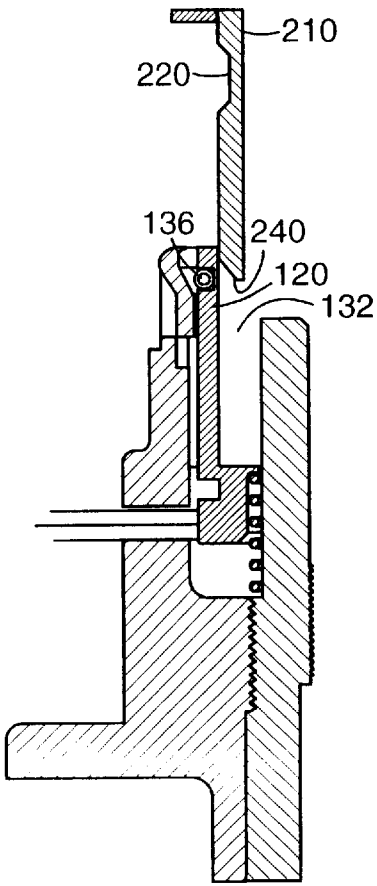
FIGS. 6–9 are a sequence of side sectional views showing insertion of the plug of FIG. 3 into the receptacle of FIG. 1.

FIGS. 6–9 illustrate the interaction between the spring carrier 120 and plug 200 when the plug is inserted into the receptacle housing 100. FIG. 6 shows plug sleeve 210 of plug 200 inserted into sleeve region 132 just until it encounters the portions of the garter spring 136 extending through slots 130, which block a portion of the sleeve region 132 until pushed aside by sleeve 210. Plug sleeve 210 has a bevelled end 240 that assists sleeve 210 in sliding over garter spring 136.

Figure 7:
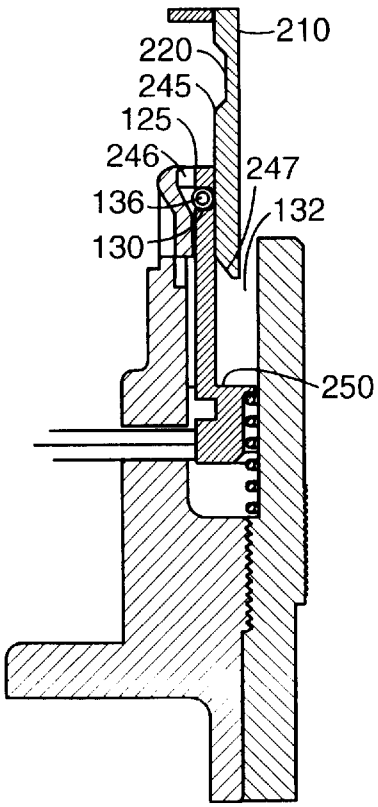

FIG. 7 shows the plug sleeve 210 further inserted into sleeve region 132. Although garter spring 136 is in tension and therefore tends to protrude into sleeve region 132 through slots 130, an outer surface 245 of plug sleeve 210 displaces the spring 136 into channel 125 and against a wider region 246 of opening 110. Further insertion of the plug sleeve 210 moves a bottom surface 247 of the sleeve toward a top surface 250 of spring carrier 120. There is little movement of spring carrier 120 as plug sleeve 210 is inserted because spring 170 resists the downward movement of spring carrier 120.

Figure 8:
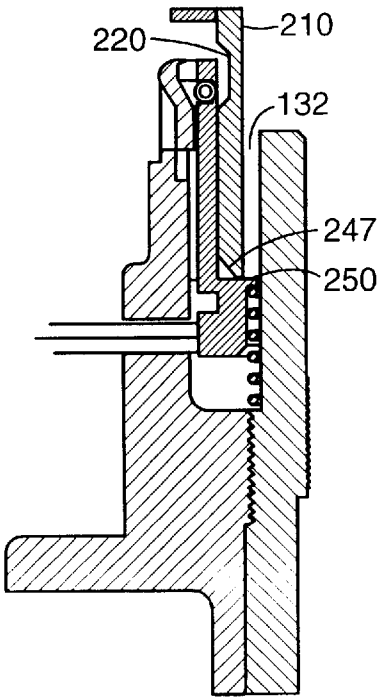

FIG. 8 shows plug sleeve 210 further inserted into sleeve region 132 until bottom surface 247 rests against top surface 250 of spring carrier 120. Before inserting the plug sleeve to this point, the spring 136 remains displaced within channel 125 by the outer surface 245 of the plug sleeve 210. Then, when plug sleeve 210 is inserted deep enough that the pair of detent slots 220 are adjacent to the pair of slots 130, spring 136 again protrudes through slots 130 and into detent slots 220.

Because the bottom edge 247 of the sleeve 210 already rests against edge 250 of the spring carrier 120, further insertion of the plug sleeve 210 moves the spring carrier 120 and compresses the spring 170 within the spring retaining channel 162. When the spring carrier 120 is completely pressed into receptacle 100, plate 142 aligns with plate receiving slot 160 and is forced by the spring 172 into the slot 160. Movement of plate 142 and corresponding rotation of shaft 138 turns on power to conductor prongs 145. This locked position is shown in FIG. 9.

Figure 9:
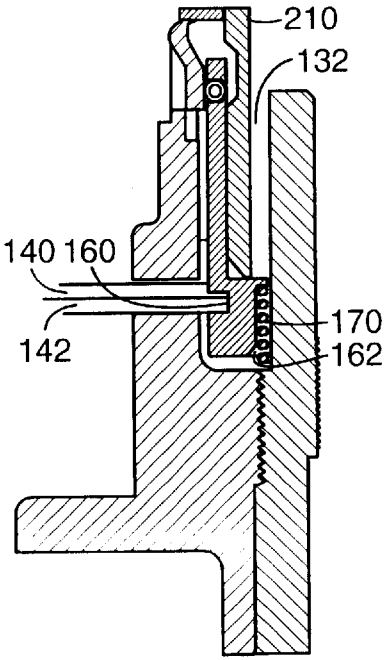

In the locked position of FIG. 9, the spring carrier is locked in place by interaction between plate 142 and slot 160. Plug 200 is held in place by interaction between garter spring 136 and detent slots 220. In particular, garter spring 136 is blocked from being pushed back into channel 125 so that plug 200 may not be pulled out past the position at which the bottom of slots 220 engage the garter spring.

Once the plug 200 is locked into place in the receptacle housing 100, threaded cap 230 may be threadably attached to threaded section 115. Attaching the cap 230 forces gasket 225 against the top of threaded section 115. The force of the cap 230 against the threaded section causes the gasket 225 to expand against sleeve 210 and the inside surface of cap 230, thereby forming a watertight seal.

To disengage plug 200 from receptacle housing 100, threaded cap 230 must be removed and release lever 105 must be moved to the power-off position in which power is no longer supplied to the receptacle conductor prongs 145. Moving the release lever 105 to the power off position pulls plate 142 out of slot 160, which permits movement of the spring carrier and removal of the plug 200. Removal of the plug 200 is resisted by the interaction between garter spring 136, detent slots 220, and outer surface 245. This resistance continues until spring carrier 120 moves far enough that channel 125 is adjacent to wider region 246, at which point the spring 136 can be displaced far enough into channel 125 to allow the plug to be removed.

Receptacle housing 100 may be made, for example, of a metal, such as aluminum or an iron alloy, and fabricated by casting. It also may be made of a polymer, such as glass filled polyester. The receptacle conductor prongs 145 may be made of a conductive material, such as brass. The gasket 225 may be made of a flexible polymer, such as neoprene.

Figure 10:
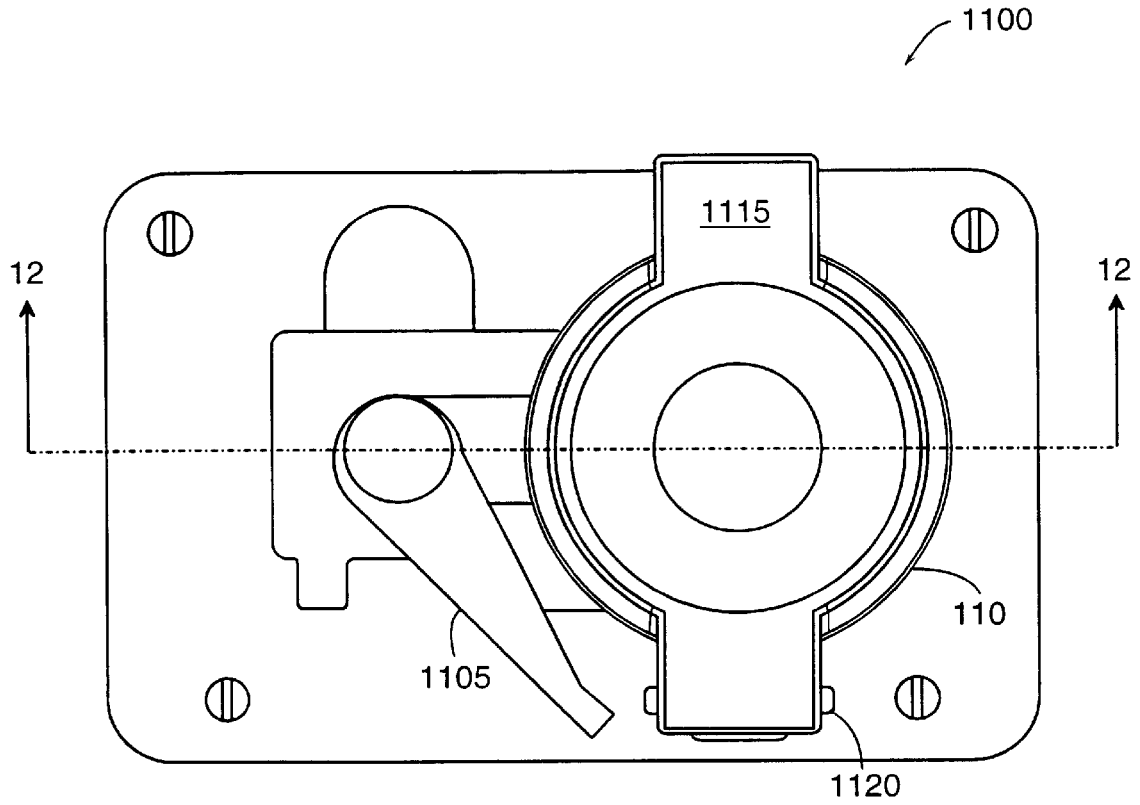
FIG. 10 is a front view of a receptacle housing.
Figure 11:
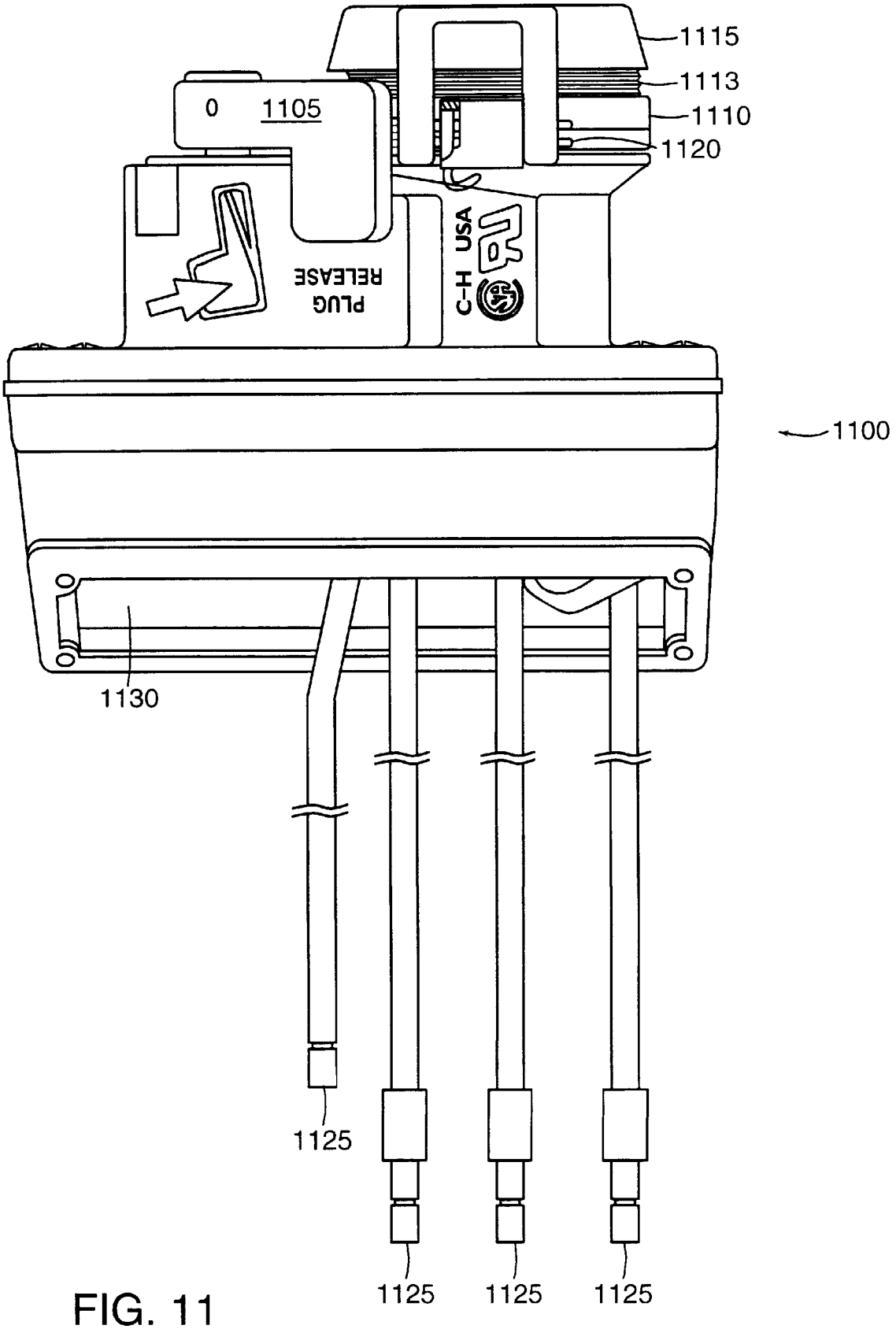
FIG. 11 is a side view of the receptacle housing of FIG. 10.

Referring to FIGS. 10 and 11, a receptacle housing 1100 includes a release lever 1105 and a receptacle 1110 having a threaded section 1113 and covered by a receptacle cover 1115. Receptacle cover 1115 is hinged at a spring-mounted hinge 1120 so that it tends to move to a closed position covering the receptacle 1110. Electrical lines 1125 supply power to the receptacle 1110 through an opening 1130.

Figure 12:
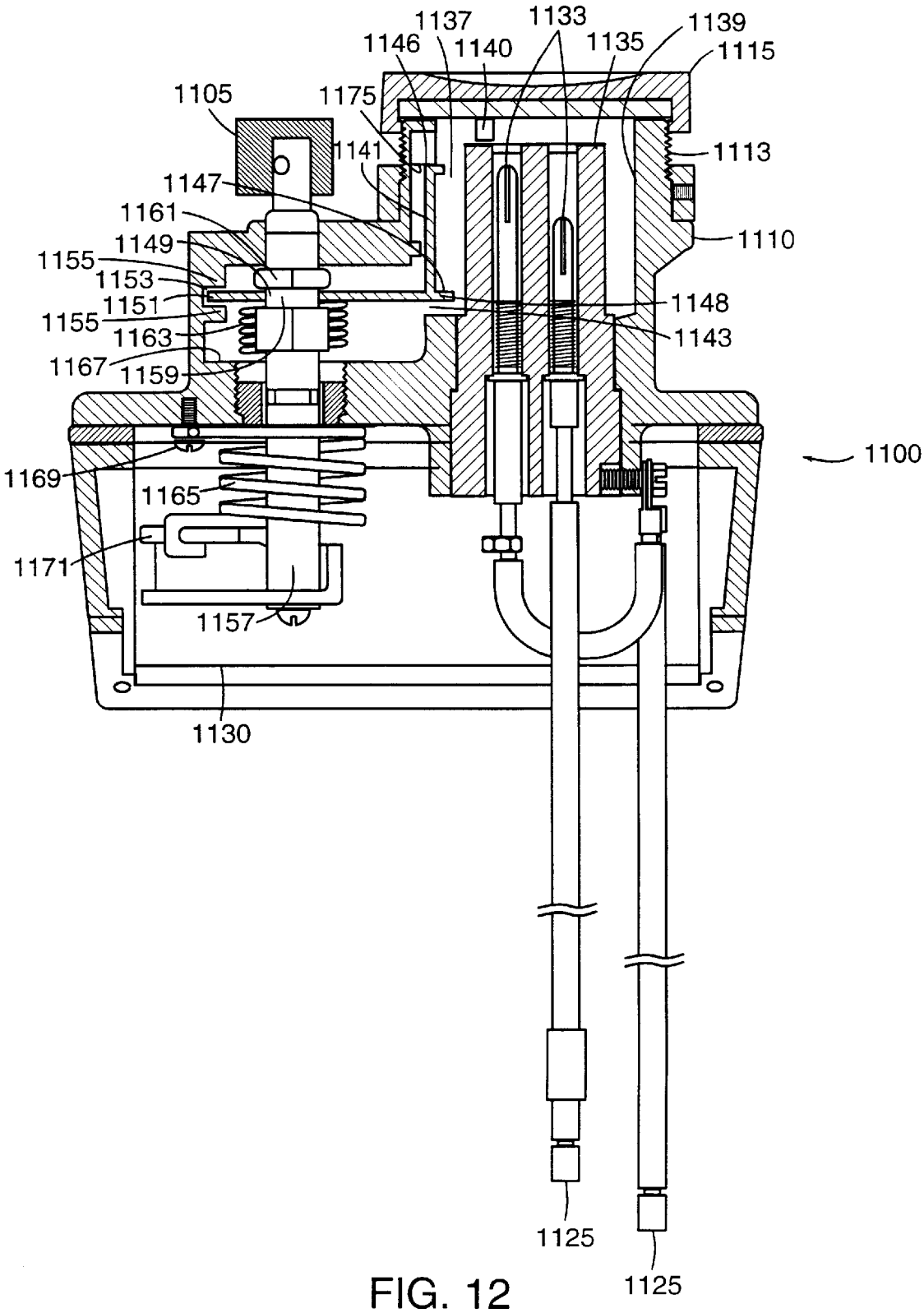
FIG. 12 is a sectional side view of the receptacle housing along section 12—12 of FIG. 10.

Referring to FIG. 12, receptacle 1110 includes receptacle conductor prongs 1133, which are connected to electrical lines 1125. Prongs 1133 reside in an insulator 1135. A sleeve region 1137 is defined between insulator 1135 and an inner circumference 1139 of receptacle 1110. A guide pin 1140 is positioned on the inner circumference 1139, and a cam hinge lock 1141 is positioned adjacent to insulator 1135 in an opening 1143 of inner circumference 1139. Cam hinge lock 1141 is generally L-shaped and includes a detent tab 1145 on a top end 1146 and a pair of trigger tabs 1147 on a bottom end 1148. On a lateral end away from the trigger tabs 1147, the cam hinge lock includes a square channel 1149 and a cam hinge 1151. The cam hinge 1151 fits into a cam opening 1153 formed by a pair of hinge tabs 1155. Positioning cam hinge 1151 within cam opening 1153 allows cam hinge lock 1141 to pivot along a shaft 1157.

Figure 14:
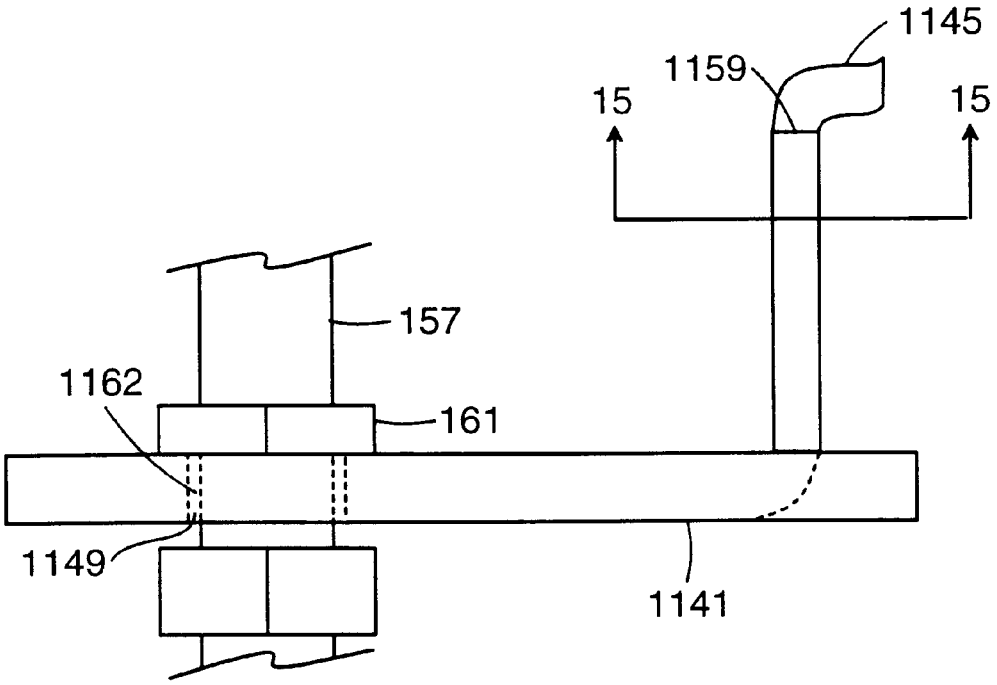
FIG. 14 is a side view of the cam hinge lock of FIG. 13 in a lower position.
Figure 13:
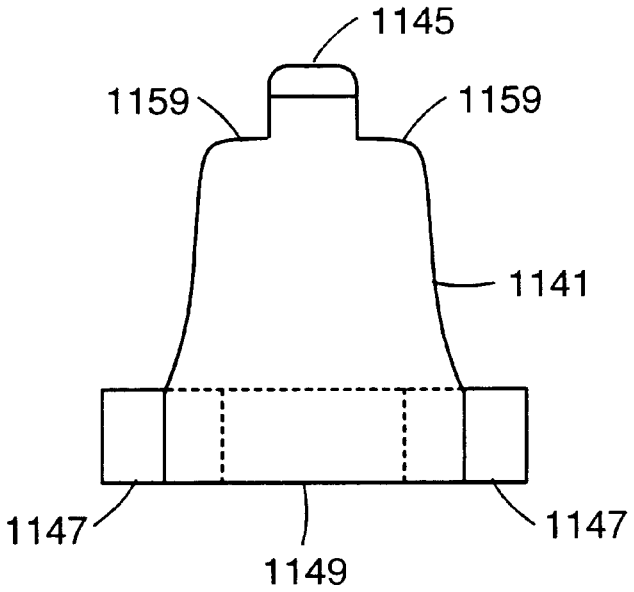
FIG. 13 is a front view of a cam hinge lock of the receptacle housing of FIG. 10.
Figure 15:
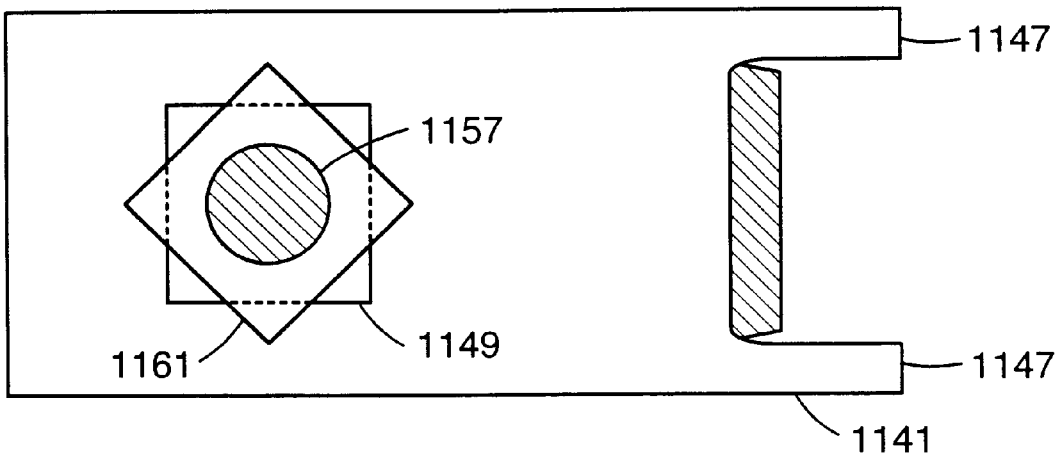
FIG. 15 is a sectional top view of the cam hinge lock in a lower position along section 15—15 of FIG. 14.

The cam hinge lock 1141 is shown in greater detail in FIGS. 13–16. Referring to FIG. 13, shoulders 1159 are adjacent to detent tab 1145. FIGS. 14 and 15 show the cam hinge lock 1141 in a lower position relative to a square segment 1161 of shaft 1157. In this position, the square segment 1161 is adjacent to square channel 1149 and rotated relative to square channel 1149 so as to not fit within square channel 1149. Instead, square channel 1149 surrounds a round segment 1162 of shaft 1157.

Figure 16:
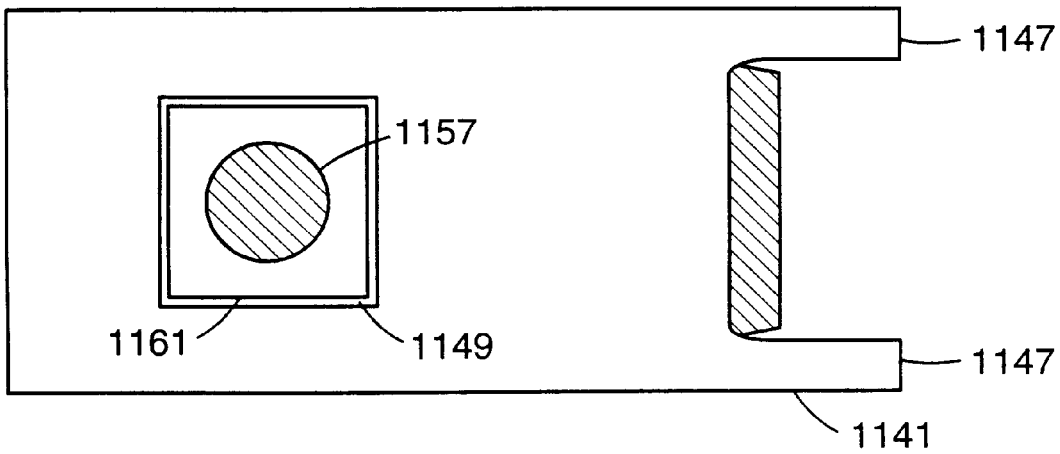
FIG. 16 is a sectional side view of the cam hinge lock in an upper position along section 15—15 of FIG. 14.

FIG. 16 shows the cam hinge lock 1141 in an upper position relative to the square segment 1161. In the upper position, the square channel 1149 is aligned with and surrounds square segment 1161.

Referring again to FIG. 12, a pair of springs 1163 and 1165 resist both up and down movement of the cam hinge lock 1141. Spring 1163 resists downward movement of cam hinge lock 1141 because the spring is compressed between cam hinge lock 1141 and a surface 1167 within receptacle housing 1100. Pushing cam hinge lock 1141 downward causes additional compression of spring 1163 thereby resisting downward movement.

Spring 1165 indirectly resists the upward movement of cam hinge lock 1141 by resisting the movement of release handle 1105, which is attached to and controls the movement of shaft 1157. Spring 1165 is positioned around shaft 1157 and fixed at one end to receptacle housing 1100 by a restraining screw 1169 and at another end by an interlock arm 1171. Moving release lever 1105 rotates shaft 1157 and causes interlock arm 1171 to move a corresponding amount about the axis of shaft 1157. The movement of interlock arm 1171 tightens the degree to which spring 1165 is coiled, and, therefore, is resisted by spring 1165.

Springs 1163 and 1165 function together to move the cam hinge lock 1141 to the upper position. With cam hinge lock 1141 in the lower position, as shown in FIG. 12, spring 1163 is compressed by the cam hinge lock. Upward movement of the cam hinge lock 1141 is prevented by the positioning of square segment 1161 of shaft 1157, which is not in alignment with the square channel 1149. Moving release lever 1105 against the force of spring 1165 rotates square segment 1161 into alignment with square channel 1149. The compressive force within spring 1163 then pushes cam hinge lock 1141 up so that square channel 1149 surrounds square segment 1161. The upward movement of cam hinge lock 1141 is limited by a pair of edges 1175 against which shoulders 1159 abut as cam hinge lock 1141 moves up.

Figure 17:
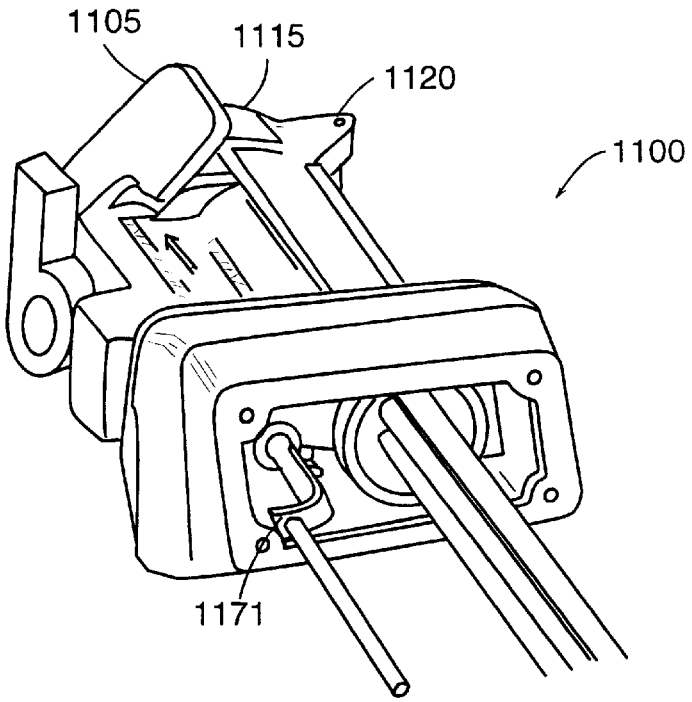
FIG. 17 is a perspective view of the receptacle housing of FIG. 10 with a switch interlock rod in an unpowered position.

Referring to FIG. 17, to insert the plug 200 in the receptacle 1100, the release lever 1105 must be in a disengaged position as illustrated in FIG. 17. The release lever 1105 is manually rotated to the disengaged position when the plug 200 is removed from the receptacle 1100 and stays in the disengaged position until the plug is again engaged in the receptacle. Rotating the release lever 1105 to the disengaged position causes square channel 1149 to surround and engage the square segment 1161 as described above with reference to FIG. 11.

Figure 18:
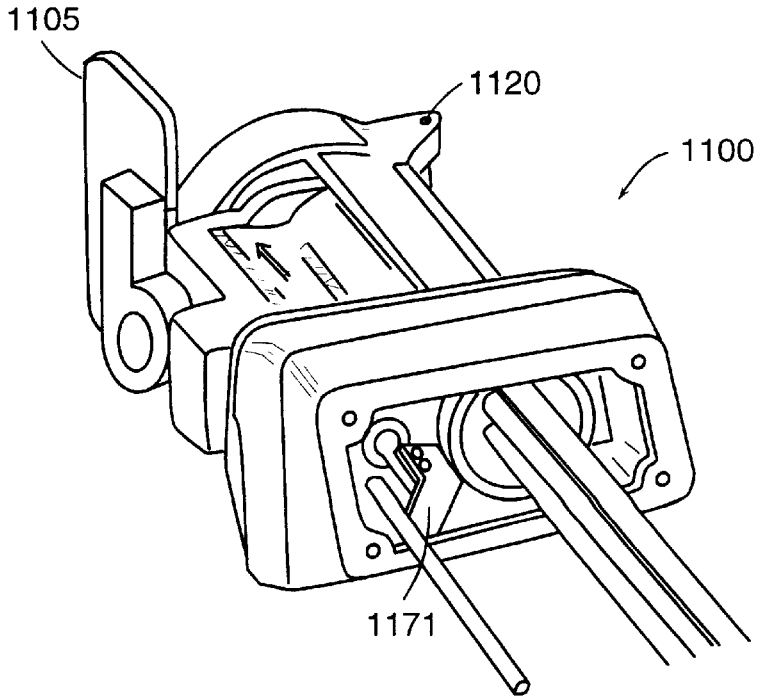
FIG. 18 is a perspective view of the receptacle housing of FIG. 10 with a switch interlock rod in a powered position.

As described in greater detail below, the release lever is automatically moved to an engaged position by the interaction between cam hinge lock 1141 and plug sleeve 210, illustrated in FIG. 18, when the plug 200 is engaged in the receptacle.

Figure 21:
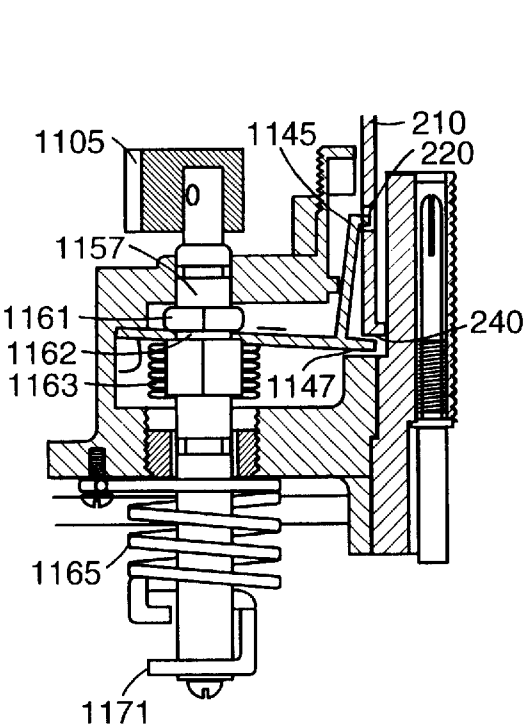
FIGS. 19–21 are a sequence of side sectional views showing insertion of the plug of FIG. 3 into the receptacle of FIG. 10.
Figure 20:
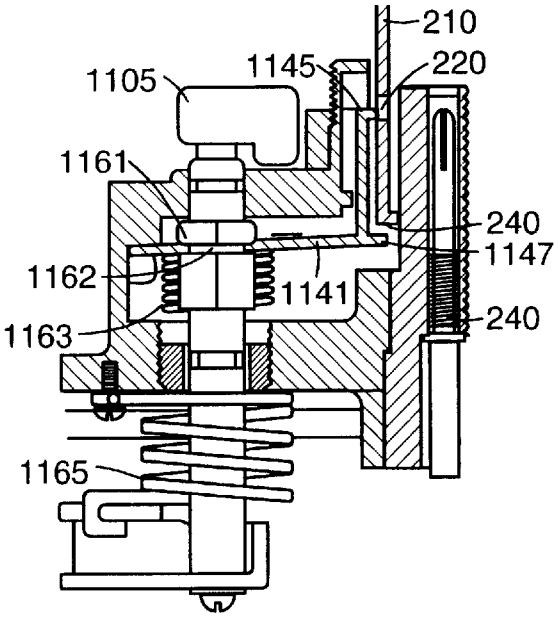
Figure 19:
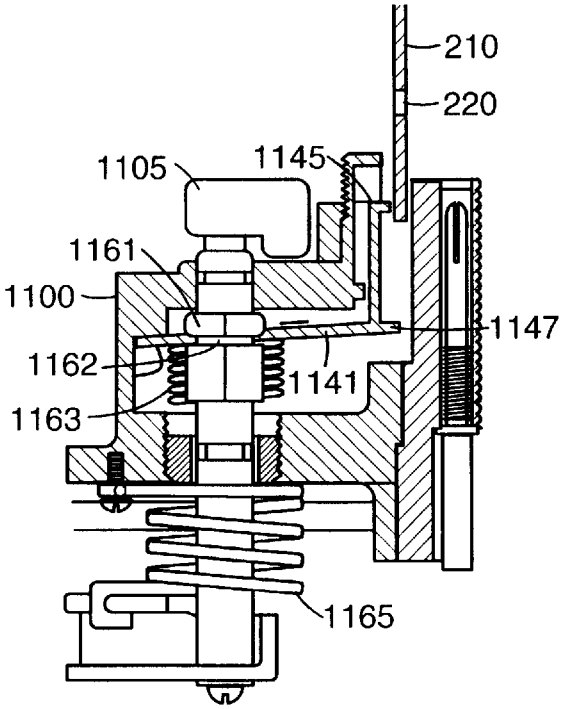

FIGS. 19–21 illustrate the interaction between the cam hinge lock 1141 and plug 200 when the plug is inserted into the receptacle housing 1100. This interaction controls the forces exerted by springs 1163 and 1165.

Referring to FIG. 19, release lever 1105 is in the disengaged position illustrated in FIG. 17 and plug sleeve 210 is partially inserted into sleeve region 1137 so that it is adjacent to insulator 1135. The square channel 1149 of the cam hinge lock 1141 partially surrounds the square segment 1161 of shaft 1157. Spring 1163 exerts a force to maintain the cam hinge lock 1141 in this position while at the same time spring 1165 exerts an opposing force that tends to rotate the release lever to rotate the shaft 1157. Because of the engagement of square segment 1161 with square channel 1149, however, the cam hinge lock 1141 remains in this position.

Referring to FIG. 20, the plug sleeve 210 is further inserted into sleeve region 1137. Detent slot 220 is adjacent to detent tab 1145 and bottom edge 240 is adjacent to, although not in contact with, trigger tabs 1147. The opposing forces of springs 1163 and 1165 remain restrained by the engagement of square segment 1161 with square channel 1149.

Referring to FIG. 21, the plug sleeve 210 is fully inserted into sleeve region 1137 as characterized by the insertion of detent tab 1145 in detent slot 220 and the contact between bottom edge 240 and trigger tabs 1147. When bottom edge 240 contacts trigger tabs 1147, cam hinge lock 1141 pivots down along shaft 1157 from square section 1161 to round segment 1162. This movement releases the opposing forces of springs 1163 and 1165 which causes release lever 1105 to rotate to an engaged position. Rotating release lever 1105 also rotates shaft 1157 so that interlock arm 1171 is rotated to activate a switch to supply electrical power to receptacle conductor prongs 1133.

After fully inserting the plug 200 into the receptacle housing 1100, threaded cap 230 may be threadably attached to the threaded section 1115. Attaching the cap 230 forces gasket 225 against the top of threaded section 1115. The force of the cap 230 against the threaded section causes the gasket 225 to expand against sleeve 210 and the inside surface of cap 230, thereby forming a watertight seal.

The plug 200 is secured in the receptacle housing by the insertion of detent tab 1145 in detent slot 220. Thus, to disengage plug 200 from receptacle housing 1100, the detent tab 1145 must be pulled out of the detent slot 200. This is accomplished by rotating release lever 1105 from the engaged position described above with reference to FIG. 18 to the disengaged position described above with reference to FIG. 17. Moving the release lever 1105 to the disengaged position moves interlock arm 1171 so that power is no longer supplied to the receptacle conductor prongs 1133.

Receptacle housing 1100 may be made, for example, of a metal, such as aluminum or an iron alloy, and fabricated by casting. It also may be made of a polymer, such as glass filled polyester. The receptacle conductor prongs 1145 may be made of a conductive material, such as brass.

Figure 22:
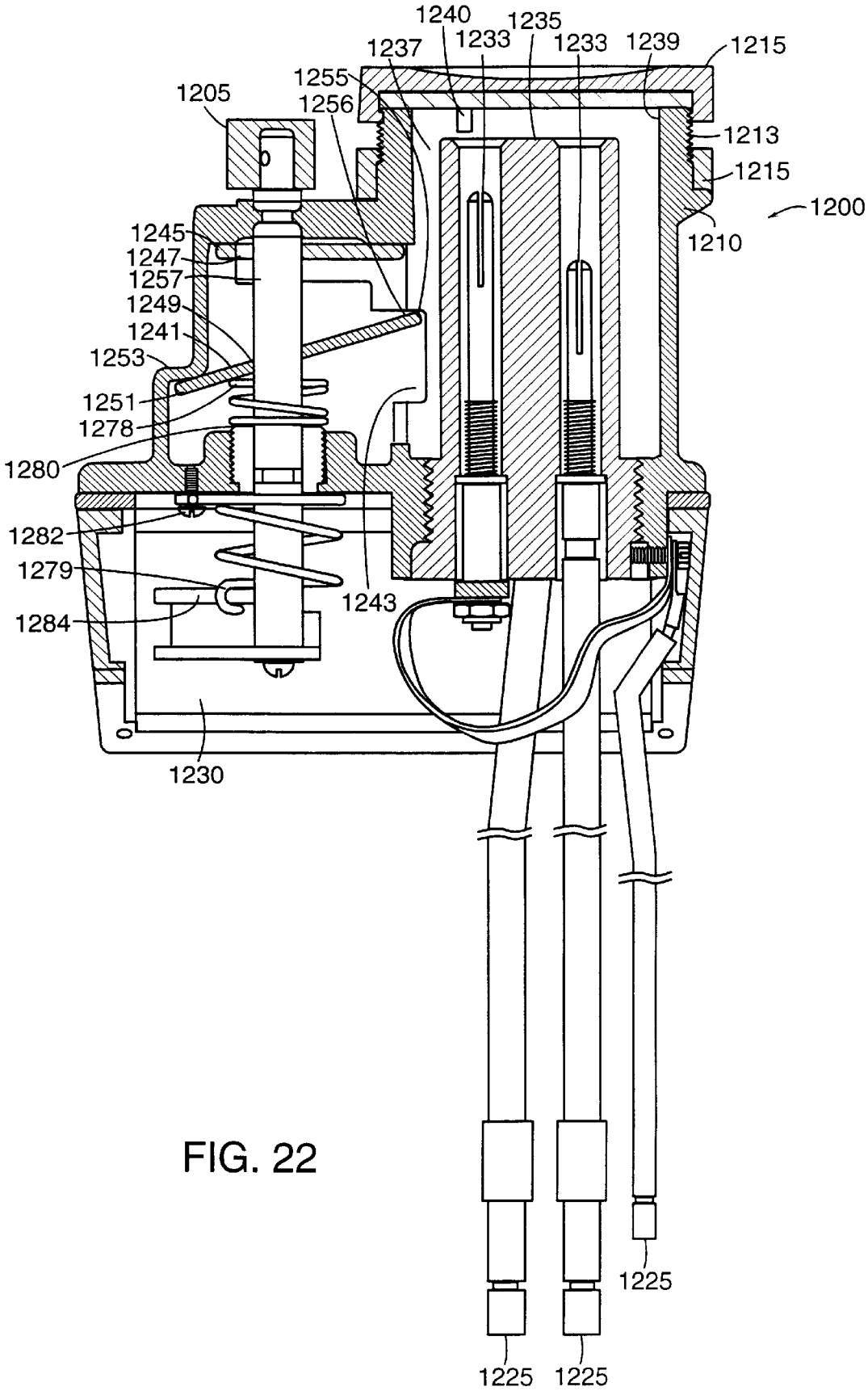
FIG. 22 is a sectional side view of a receptacle housing.

Referring to FIG. 22, a receptacle housing 1200 includes a release lever 1205 and a receptacle 1210 having a threaded section 1213 and covered by a receptacle cover 1215. Receptacle cover 1215 is hinged at a spring-mounted hinge (not shown) so that it tends to move to a closed position covering the receptacle 1210. Electrical lines 1225 supply power to the receptacle 1210 through an opening 1230. The receptacle 1210 also includes receptacle conductor prongs 1233, which are connected to electrical lines 1225. Prongs 1233 reside in an insulator 1235. A sleeve region 1237 is defined between insulator 1235 and an inner circumference 1239 of receptacle 1210. A guide pin 1240 is positioned on the inner circumference 1239, and a cam hinge 1241 is positioned adjacent to insulator 1235 in an opening 1243 of inner circumference 1239. Cam hinge 1241 has a flat plate shape. A receptacle detent 1245 is slidably mounted in a channel 1247 cast within receptacle housing 1200.

The cam hinge 1241 includes a square channel 1249 and a cam hinge end 1251. The cam hinge end 1251 fits against a housing bend 1253 and a trigger end 1255 fits against an upper end 1256 of opening 1243. Positioning cam hinge 1241 between housing bend 1253 and upper end 1256 allows cam hinge 1241 to pivot along a shaft 1257.

Figure 25:
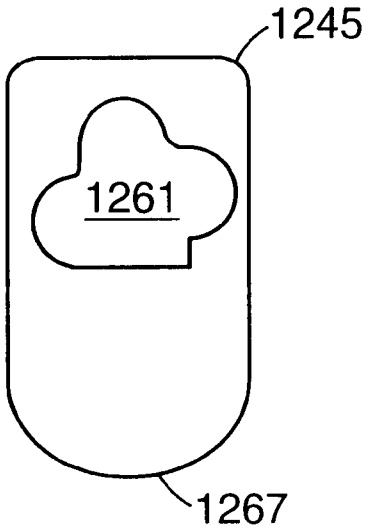
FIG. 25 is a top view of a receptacle detent having an oval end of the housing of FIG. 22.
Figure 24:
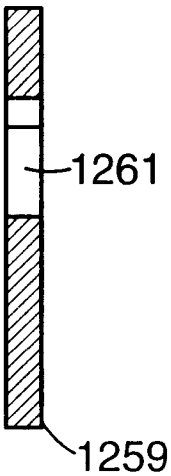
FIG. 24 is sectional side view of the receptacle detent taken along section 24—24 of FIG. 23.
Figure 23:
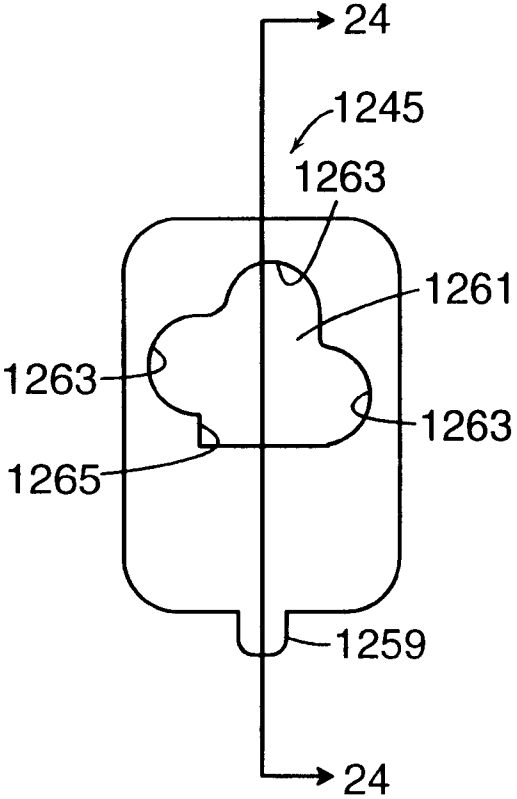
FIG. 23 is a top view of a receptacle detent having a tab of the housing of FIG. 22.

The receptacle detent 1245 is shown in greater detail in FIGS. 23–25. Referring to FIGS. 23 and 24, receptacle detent 1245 includes a tab 1259 and a channel 1261 passing through the receptacle detent. Channel 1261 includes three lobes 1263 and an angled stop 1265. Referring to FIG. 25, receptacle detent 1245 may include an oval end 1267 instead of the tab 1259.

Figure 26:
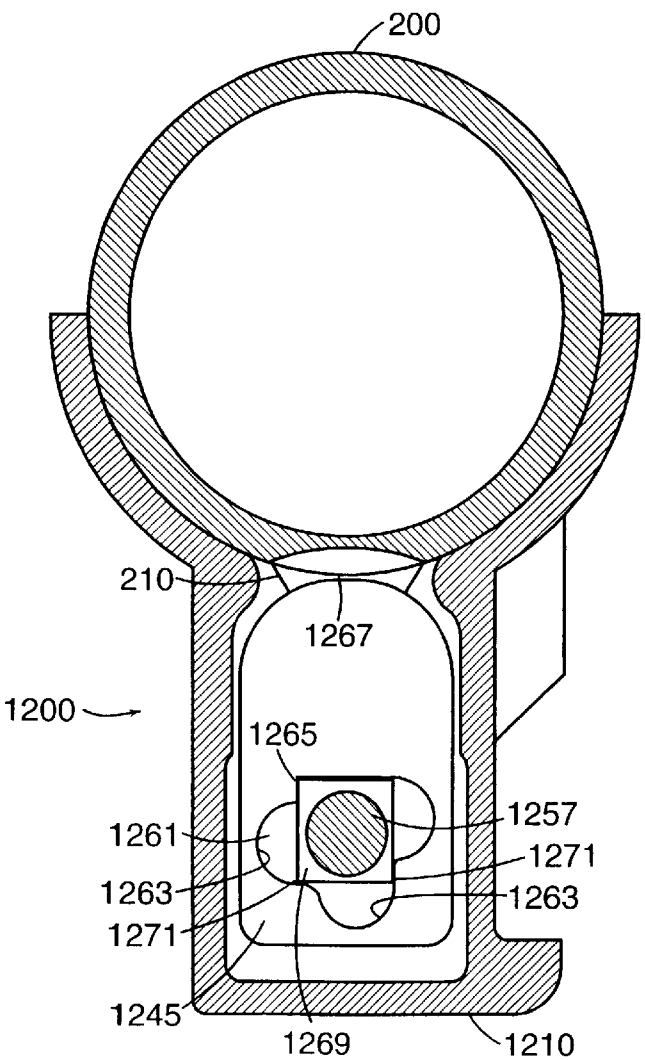

Referring to FIG. 26, plug 200 is partially inserted in receptacle 1210. Receptacle detent 1245 is in an extended position in which oval end 1267 is adjacent to plug sleeve 210. Shaft 1257 passes through opening 1261 and an upper square segment 1269 of the shaft rests against angled stop 1265. Upper square segment 1269 includes four corners 1271, two of which rest against two of lobes 1263 in the extended position.

Figure 27:
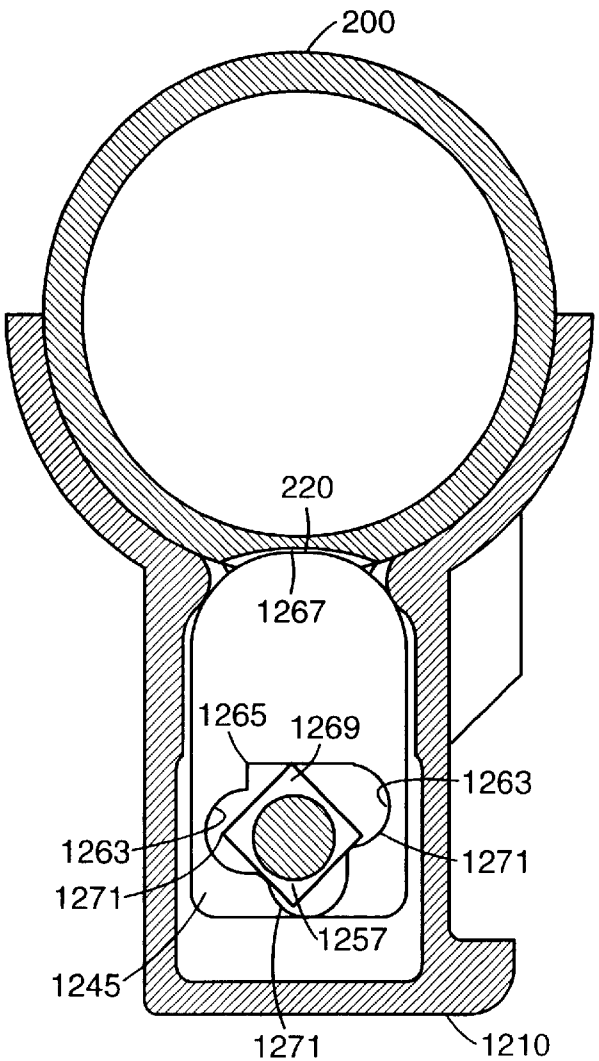
FIGS. 26 and 27 are sectional top views of the receptacle housing of FIG. 22 with the plug of FIG. 3 partially and completely inserted, respectively.

Referring to FIG. 27, plug 200 is fully inserted in receptacle 1210 and receptacle detent 1245 is in an inserted position characterized by oval end 1267 being inserted within one detent slot 220, thereby retaining plug 200 within receptacle 1210. In the inserted position, shaft 1257 is rotated approximately 45° relative to the extended position within opening 1261 such that one of the corners 1271 of upper square segment 1269 affirmatively pushes receptacle detent 1245 forward. To move between the extended and inserted positions, the corners 1271 slide along the lobes 1263 within opening 1261. Further movement of shaft 1257 is limited by the contact between oval end 1267 and plug 200 within detent slot 220 and between the corners 1271 and lobes 1263.

Figure 28:
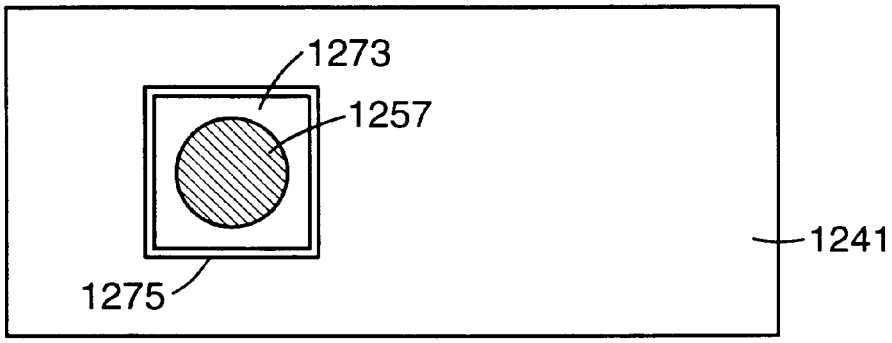

FIG. 28 shows the cam hinge 1241 in an upper position in which a lower square segment 1273 of shaft 1257 is aligned with and surrounded by a square channel 1275 of cam hinge 1241.

Figure 29:
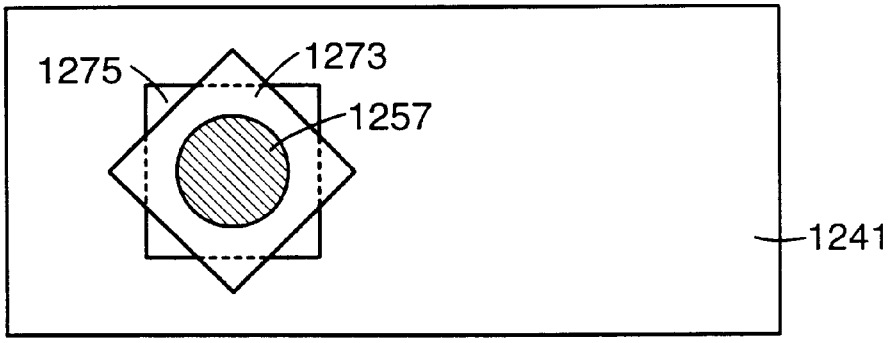
FIGS. 28 and 29 are sectional top views of a cam hinge of the housing of FIG. 22.
Figure 30:
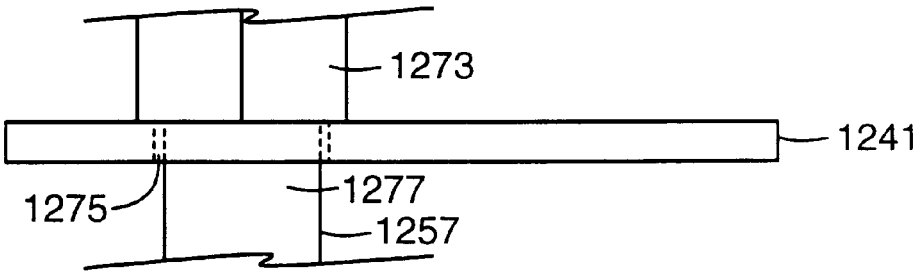
FIG. 30 is a side view of the cam hinge of FIG. 29.

FIGS. 29 and 30 show the cam hinge 1241 in a lower position in which a round segment 1277 of shaft 1257 located below lower square segment 1273 is surrounded by square channel 1275. In this position, the lower square segment 1273 is above square channel 1275 and rotated relative to square channel 1275 so as to not fit within the square channel, which prevents cam hinge 1241 from moving back to the extended position.

Referring again to FIG. 22, a pair of springs 1278 and 1279 resist both upward and downward movement of the cam hinge 1241. Spring 1278 resists downward movement of cam hinge 1241 because the spring is compressed between cam hinge 1241 and a surface 1280 within receptacle housing 1200. Pushing cam hinge 1241 downward causes additional compression of spring 1278 thereby resisting downward movement.

Spring 1279 indirectly resists the upward movement of cam hinge 1241 by resisting the movement of release handle 1205, which is attached to and controls the movement of shaft 1257. Spring 1279 is positioned around shaft 1257 and fixed at one end to receptacle housing 1200 by a restraining screw 1282 and at another end by an interlock arm 1284. Moving release lever 1205 rotates shaft 1257 and causes interlock arm 1284 to move a corresponding amount about the axis of shaft 1257. The movement of interlock arm 1284 tightens the degree to which spring 1279 is coiled, and, therefore, is resisted by spring 1279.

Springs 1278 and 1279 function together with a plug 200 to move the cam hinge 1241 to the lower position and move receptacle detent 1245 into the inserted position. With cam hinge 1241 in the extended position, as shown in FIG. 22, spring 1278 is in an uncompressed state. Downward movement of the cam hinge 1241 is resisted by spring 1278. Rotational movement of the shaft 1257 is resisted by the contact between angled stop 1265 and upper square segment 1269, which is under the rotational force exerted by spring 1279 on shaft 1257.

Figure 31:
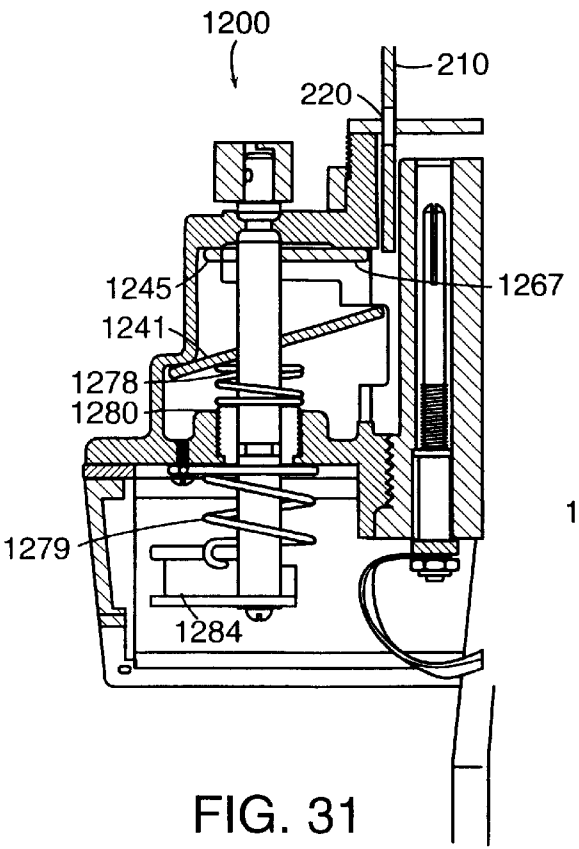

Referring to FIG. 31, the plug 200 is partially inserted in the receptacle 1200. The release lever 1205 has previously been manually rotated to a disengaged position when the plug 200 was removed from the receptacle 1200. The release lever 1205 stays in the disengaged position until the plug is again engaged in the receptacle. Rotating the release lever 1205 to the disengaged position causes square channel 1275 to surround and engage the lower square segment 1273 as described above with reference to FIGS. 29 and 30. As described in greater detail below, the release lever is automatically moved to an engaged position by the interaction between cam hinge 1241 and plug sleeve 210, illustrated in FIGS. 32 and 33, when the plug 200 is engaged in the receptacle.

Figure 33:
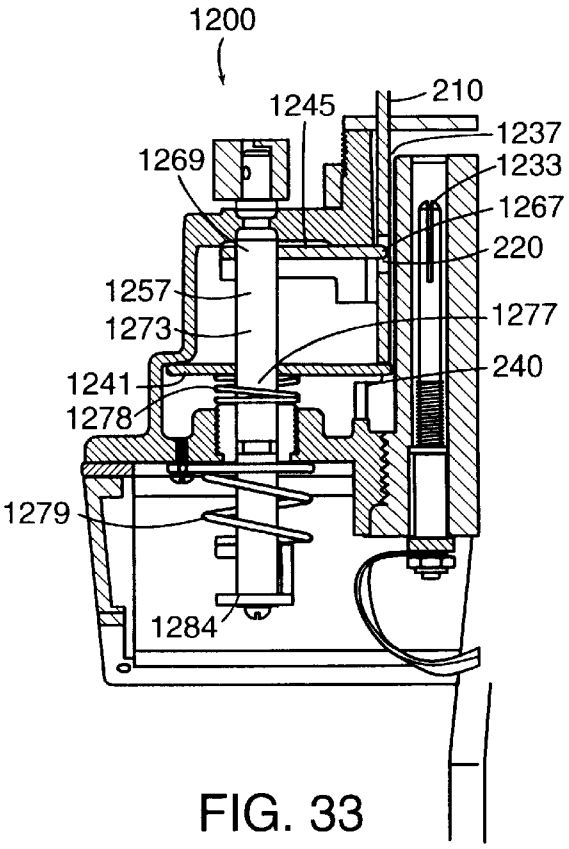
FIGS. 31–33 are a sequence of side sectional views showing insertion of the plug of FIG. 3 into the receptacle of FIG. 22.
Figure 32:
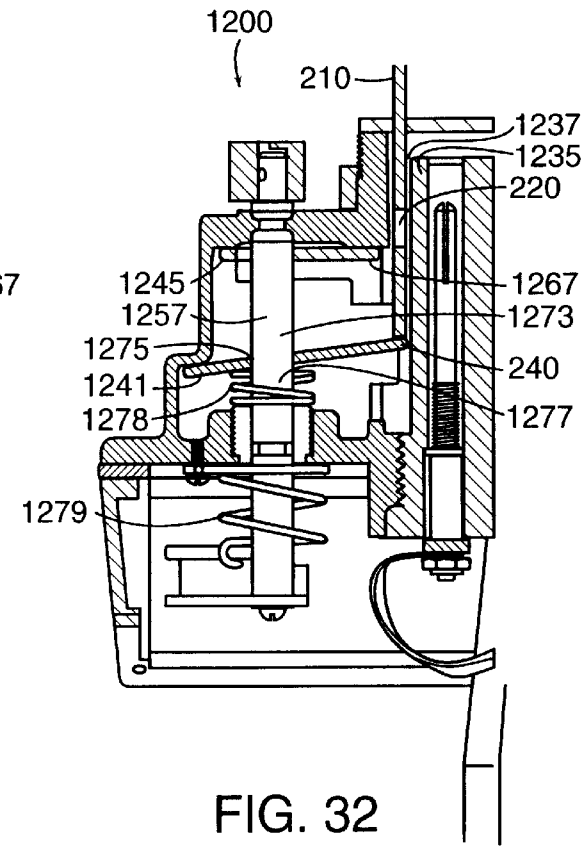

FIGS. 32 and 33 illustrate the interaction between the cam hinge 1241, receptacle detent 1245 and plug 200 when the plug is inserted into the receptacle housing 1200. This interaction controls the forces exerted by springs 1278 and 1279.

Referring to FIG. 32, plug sleeve 210 is partially inserted into sleeve region 1237 so that it is adjacent to insulator 1235 on one side and to oval end 1267 of receptacle detent 1245 on another side. Bottom edge 240 is pressed against cam hinge 1241 such that spring 1278 is in compression. When bottom edge 240 is pressed against cam hinge 1241, cam hinge 1241 pivots down shaft 1257 around lower square section 1273 toward round segment 1277. The square channel 1275 of the cam hinge 1241 partially surrounds the lower square segment 1273 of shaft 1157. Spring 1278 exerts a force to maintain the cam hinge 1241 in this position while at the same time spring 1279 exerts an opposing force that tends to rotate the release lever to rotate the shaft 1257. Because of the engagement of lower square segment 1273 with square channel 1275, however, the shaft 1257 remains in this orientation.

Referring to FIG. 33, the plug sleeve 210 is fully inserted into, and interlocked within, sleeve region 1237 as characterized by the insertion of the oval end 1267 of receptacle detent 1245 in detent slot 220. When bottom edge 240 pushes cam hinge 1241 down along shaft 1157 from lower square segment 1273 to round segment 1277, the opposing forces of springs 1278 and 1279 are released. This causes shaft 1257 to rotate, which moves release lever 1205 to rotate to the engaged position. In addition, upper square segment 1269 is rotated approximately 45°, which moves receptacle detent 1245 such that oval end is inserted into detent slot 220. Finally, shaft 1257 rotates interlock arm 1284 to activate a switch to supply electrical power to receptacle conductor prongs 1233.

After fully inserting the plug 200 into the receptacle housing 1200, threaded cap 230 may be threadably attached to the threaded section 1213. Attaching the cap 230 forces gasket 225 against the top of threaded section 1213. The force of the cap 230 against the threaded section causes the gasket 225 to expand against sleeve 210 and the inside surface of cap 230, thereby forming a watertight seal.

The plug 200 is secured in the receptacle housing by the insertion of the oval end 1267 of receptacle detent 1245 in detent slot 220. Thus, to disengage plug 200 from receptacle housing 1200, the oval end 1267 must be pulled out of the detent slot 200. This is accomplished by rotating release lever 1205 from the engaged position to the disengaged position. Moving the release lever 1205 to the disengaged position moves interlock arm 1284 so that power is no longer supplied to the receptacle conductor prongs 1233.

Receptacle housing 1200 may be made, for example, of a metal, such as aluminum or an iron alloy, and fabricated by casting. It also may be made of a polymer, such as glass filled polyester. The receptacle conductor prongs 1245 may be made of a conductive material, such as brass.

Other embodiments are within the scope of the following claims. For example, the blocking element (i.e., garter spring 136) may be a flexible rod or a set of bearings that encircle at least a portion of the spring carrier 120 and can be displaced into channel 125.

What is claimed is:

1. An electrical receptacle comprising:

a receptacle housing defining a receptacle opening having a longitudinal axis;

a movable element positioned within the receptacle opening and configured to move along the longitudinal axis between an extended position and an inserted position;

an interlock mechanism connected to interlock with the movable element when the movable element is in the inserted position, the interlock mechanism maintaining the movable element in the inserted position;

a release mechanism coupled to the interlock mechanism, accessible from outside the receptacle housing, and operable to disengage the interlock mechanism from the movable element to permit the movable element to move to the extended position; and a blocking element positioned within the receptacle opening and configured to move along the longitudinal axis with the movable element, to fixedly block a portion of the receptacle opening when the movable element is in the inserted position, and not to fixedly block the receptacle opening when the movable element is in the extended position.

2. The electrical receptacle of claim 1, further comprising:

at least one electrical conductor; and a switching circuit configured to supply electrical power to the conductor when the movable element is in the inserted position and the interlock mechanism is interlocked with the movable element and to not supply electrical power when the movable element is in the extended position.

3. The electrical receptacle of claim 1, wherein the blocking element is configured to engage a plug inserted into the receptacle opening so that the plug is not removable from the opening when the movable element is in the inserted position.

4. The electrical receptacle of claim 1, further comprising a mechanism for biasing the movable element to the extended position.

5. The electrical receptacle of claim 4, wherein the biasing mechanism comprises a spring.

6. The electrical receptacle of claim 1, wherein the blocking element is mounted on the movable element.

7. The electrical receptacle of claim 6, wherein the blocking element comprises a garter spring.

8. The electrical receptacle of claim 7, wherein the movable element comprises a spring carrier having a slot through which a portion of the garter spring extends.

9. The electrical receptacle of claim 8, wherein the garter spring is prevented from retracting from the slot when the movable element is in the inserted position.

10. The electrical receptacle of claim 8, wherein the spring extends through the slot but may be retracted when the movable element is in the extended position.

11. The electrical receptacle of claim 6, wherein the blocking element comprises a flexible rod.

12. The electrical receptacle of claim 1, wherein the interlock mechanism comprises a plate configured to fit within a channel in the movable element when the movable element is in the inserted position.

13. The electrical receptacle of claim 1, wherein the movable element includes a first channel that communicates with the opening through an inner circumference of the movable element and the blocking element is disposed within the first channel.

14. The electrical receptacle of claim 13, wherein the movable element includes a second channel along at least a portion of its outer circumference and the interlock mechanism comprises a plate configured to fit within the second channel when the movable element is in the inserted position.

15. The electrical receptacle of claim 1, wherein the receptacle housing includes an exterior threaded section configured to be threadably connected to a threaded cap of an electrical plug when the plug is in the receptacle housing.

16. The electrical receptacle of claim 1, wherein the blocking element comprises an arm extending from the movable element.

17. The electrical receptacle of claim 1, wherein the movable element comprises a cam hinge lock configured to move between the extended position and the inserted position.

18. The electrical receptacle of claim 17, wherein the cam hinge lock has a square channel passing through it and includes a detent tab, a trigger tab, and a hinge end positioned within a cam opening.

19. The electrical receptacle of claim 18, further comprising a release lever connected to a shaft having a square segment and a round segment, wherein the square channel surrounds the square segment in the extended position and the square channel surrounds the round segment in the inserted position.

20. The electrical receptacle of claim 19, further comprising a biasing mechanism to move the cam hinge lock to the extended position.

21. The electrical receptacle of claim 20, wherein the biasing mechanism comprises a spring and the spring is attached on a first end to the cam hinge lock and on a second end to the receptacle housing.

22. The electrical receptacle of claim 21, further comprising a second spring configured to rotate the shaft, wherein rotating the shaft causes the cam hinge lock to move to the inserted position.

23. The receptacle housing of claim 22, wherein the second spring is attached on a first end to the receptacle housing and on a second end is attached to the shaft or an attachment to the shaft.

24. The receptacle housing of claim 18, wherein depressing the trigger tab moves the cam hinge lock to the inserted position.

25. The receptacle housing of claim 24, wherein the detent tab comprises the blocking element.

26. The receptacle housing of claim 25, wherein moving the cam hinge lock to the inserted position inserts the detent tab into the receptacle opening.

27. The receptacle housing of claim 26, wherein moving the cam hinge lock to the extended position removes the detent tab from the detent slot.

28. The receptacle housing of claim 25, wherein the detent tab on the cam hinge lock comprises the interlocking mechanism.

29. An electric circuit including:

an electrical plug; and an electrical receptacle comprising a receptacle housing defining a receptacle opening having a longitudinal axis;

a movable element positioned within the receptacle opening and configured to move along the longitudinal axis between an extended position and an inserted position;

an interlock mechanism connected to interlock with the movable element when the movable element is in the inserted position, the interlock mechanism maintaining the movable element in the inserted position;

a release mechanism coupled to the interlock mechanism, accessible from outside the receptacle housing, and operable to disengage the interlock mechanism from the movable element to permit the movable element to move to the extended position; and a blocking element positioned within the receptacle opening and configured to move along the longitudinal axis with the movable element, to fixedly block a portion of the receptacle opening when the movable element is in the inserted position, and not to fixedly block the receptacle opening when the movable element is in the extended position.

30. The electrical circuit of claim 29, further comprising:

at least one electrical conductor; and a switching circuit configured to supply electrical power to the conductor when the movable element is in the inserted position and the interlock mechanism is interlocked with the movable element and to not supply electrical power when the movable element is in the extended position.

31. The electrical circuit of claim 29, wherein the plug has at least one detent slot and is configured to be inserted into the opening.

32. The electrical circuit of claim 31, wherein the blocking element is displaced from the opening when the plug is inserted and the movable element is in the extended position.

33. The electrical circuit of claim 32, wherein the blocking element extends into the opening and fits within the detent slot when the plug is inserted and the movable element is in the inserted position.

34. The electrical circuit of claim 33, wherein the movable element comprises a spring carrier having a slot through which a portion of the garter spring extends.

35. The electrical circuit of claim 34, wherein the garter spring is prevented from retracting from the slot when the movable element is in the inserted position.

36. The electrical circuit of claim 31, wherein the movable element comprises a cam hinge lock configured to move between the extended position and the inserted position.

37. The electrical circuit of claim 36, wherein the cam hinge lock has a square channel passing through it and includes a detent tab, a trigger tab, and a hinge end positioned within a cam opening.

38. The electrical circuit of claim 37, further comprising a release lever connected to a shaft having a square segment and a round segment, wherein the square channel surrounds the square segment in the extended position and the square channel surrounds the round segment in the inserted position.

39. The electrical circuit of claim 37, wherein the detent tab comprises the blocking element.

40. The electrical circuit of claim 37, wherein the detent tab on the cam hinge lock comprises the interlocking mechanism.

41. A method of interlocking a plug in an electrical receptacle, the method comprising:

providing a plug having at least one detent slot;

providing an electrical receptacle comprising (a) a receptacle housing defining a receptacle opening having a longitudinal axis; (b) a movable element positioned within the receptacle opening and configured to move along the longitudinal axis between an extended position and an inserted position; (c) an interlock mechanism connected to interlock with the movable element when the movable element is in the inserted position, the interlock mechanism maintaining the movable element in the inserted position; (d) a release mechanism coupled to the interlock mechanism, accessible from outside the receptacle housing, and operable to disengage the interlock mechanism from the movable element to permit the movable element to move to the extended position; and (e) a blocking element positioned within the receptacle opening and configured to move along the longitudinal axis with the movable element, to fixedly block a portion of the receptacle opening when the movable element is in the inserted position, and not to fixedly block the receptacle opening when the movable element is in the extended position;

inserting the plug into the electrical receptacle; and interlocking the plug in the electrical receptacle.

42. The method of claim 41, further comprising displacing the blocking element from the opening when the plug is inserted and the movable element is in the extended position.

43. The method of claim 42, further comprising forcing the blocking element into the opening when the plug is inserted and the movable element is in the inserted position.

44. The method of claim 41, wherein interlocking the plug in the receptacle housing comprises inserting a plate into a slot of the movable element when the movable element is in the inserted position.

45. The method of claim 41, further comprising causing electrical power to be supplied to a receptacle conductor prong when the movable element is in the inserted position.

46. The method of claim 45, further comprising disengaging the plate from the movable element to discontinue the supply of electrical power to the receptacle conductor prong.

47. The method of claim 41, wherein the plug includes a threaded cap and the threaded cap is threadably attached to an exterior threaded section of the receptacle housing.

48. The method of claim 41, wherein the movable element comprises a cam hinge lock configured to move between the extended position and the inserted position.

49. The method of claim 48, wherein the cam hinge lock has a square channel passing through it and includes a detent tab, a trigger tab, and a hinge end positioned within a cam opening.

50. The method of claim 49, further comprising a release lever connected to a shaft having a square segment and a round segment, wherein the square channel surrounds the square segment in the extended position and the square channel surrounds the round segment in the inserted position.

51. The method of claim 50, further comprising a first spring configured to move the cam hinge lock to the extended position and a second spring configured to rotate the shaft, wherein rotating the shaft causes the cam hinge lock to move to the inserted position.

52. The method of claim 49, wherein inserting the plug causes a bottom edge of the plug to contact the trigger tab, which moves the cam hinge lock to the inserted position.

53. The method of claim 52, wherein moving the cam hinge lock to the inserted position inserts the detent tab into the detent slot of the plug.

54. An electrical receptacle comprising:

a receptacle housing defining a receptacle opening having a longitudinal axis;

a movable element positioned within the receptacle opening and configured to move along the longitudinal axis between an extended position and an inserted position;

an interlock mechanism connected to interlock with the movable element when the movable element is in the inserted position, the interlock mechanism maintaining the movable element in the inserted position and including a shaft that rotates between a first position when the movable element is in the extended position and a second position when the movable element is in the inserted position;

a release mechanism coupled to the interlock mechanism, accessible from outside the receptacle housing, and operable to disengage the interlock mechanism from the movable element to permit the movable element to move to the extended position; and a blocking element positioned adjacent to the receptacle opening and configured to move along an axis perpendicular to the longitudinal axis to fixedly block a portion of the receptacle opening when the movable element is in the inserted position, and not to fixedly block the receptacle opening when the movable element is in the extended position, the blocking element being coupled to the shaft such that movement of the shaft from the first position to the second position affirmatively causes the blocking element to block the receptacle opening and movement of the shaft from the second position to the first position affirmatively retracts the blocking element so as not to block the receptacle opening.

55. The electrical receptacle of claim 54, wherein the blocking element is configured to engage a plug inserted into the receptacle opening so that the plug is not removable from the opening when the movable element is in the inserted position.

56. The electrical receptacle of claim 54, further comprising a mechanism for biasing the movable element to the extended position.

57. The electrical receptacle of claim 56, wherein the biasing mechanism comprises a spring.

58. The electrical receptacle of claim 54, wherein the blocking element comprises a receptacle detent.

59. The electrical receptacle of claim 58, wherein the receptacle detent comprises a plate having a channel through the plate adjacent to a first end and a detent at a second end.

60. The electrical receptacle of claim 59, wherein the channel has lobes and an angled stop.

61. The electrical receptacle of claim 54, wherein the movable element comprises a cam hinge having a square channel passing through it and configured to move between the extended position and the inserted position.

62. The electrical receptacle of claim 61, further comprising a release lever connected to the shaft and the shaft includes a lower square segment and a lower round segment and the square channel surrounds the lower square segment in the extended position and the square channel surrounds the lower round segment in the inserted position.

63. The electrical receptacle of claim 62, wherein the shaft includes an upper square segment that passes through the channel of the receptacle detent and a first corner of the upper square segment pushes the detent into the receptacle opening in the inserted position and a second corner of the upper square segment pushes the detent from the receptacle opening in the extended position.

64. The electrical receptacle of claim 62, further comprising a biasing mechanism to move the cam hinge to the extended position.

65. The electrical receptacle of claim 64, wherein the biasing mechanism comprises a spring and the spring is attached on a first end to the cam hinge and on a second end to the receptacle housing.

66. The electrical receptacle of claim 65, further comprising a second spring configured to rotate the shaft, wherein rotating the shaft causes the cam hinge to move to the inserted position.

67. The receptacle housing of claim 66, wherein the second spring is attached on a first end to the receptacle housing and on a second end is attached to the shaft.

* * * * *